US009682750B2

(12) United States Patent
Thelander

(10) Patent No.: US 9,682,750 B2
(45) Date of Patent: Jun. 20, 2017

(54) PASSENGER BRIDGES FOR CONNECTION TO A DOOR IN THE SIDE OF A SHIP

(71) Applicant: FMT INTERNATIONAL TRADE AB, Trelleborg (SE)

(72) Inventor: Per Thelander, Höllviken (SE)

(73) Assignee: FMT International Trade AB, Trelleborg (SE)

( * ) Notice: Subject to any disclaimer, the term of this patent is extended or adjusted under 35 U.S.C. 154(b) by 0 days.

(21) Appl. No.: 14/917,664

(22) PCT Filed: Mar. 14, 2014

(86) PCT No.: PCT/SE2014/050313

§ 371 (c)(1),
(2) Date: Mar. 9, 2016

(87) PCT Pub. No.: WO2015/034412

PCT Pub. Date: Mar. 12, 2015

(65) Prior Publication Data

US 2016/0214688 A1 Jul. 28, 2016

(30) Foreign Application Priority Data

Sep. 9, 2013 (SE) ..... 1351035

(51) Int. Cl.
*E01D 15/00* (2006.01)
*B63B 27/14* (2006.01)
*E01D 15/24* (2006.01)

(52) U.S. Cl.
CPC ..... *B63B 27/14* (2013.01); *E01D 15/24* (2013.01)

(58) Field of Classification Search
CPC ..... B63B 27/14; E01D 15/24
(Continued)

(56) References Cited

U.S. PATENT DOCUMENTS 3,713,183 A 1/1973 Belisle
5,950,266 A 9/1999 Streeter
(Continued)

FOREIGN PATENT DOCUMENTS

ES 2302476 A1 7/2008
JP S63125707 A 5/1988
(Continued)

OTHER PUBLICATIONS

International Search Report from counterpart International Patent Application No. PCT/SE2014/050313, mailed Jun. 12, 2014.
(Continued)

*Primary Examiner* — Raymond W Addie
(74) *Attorney, Agent, or Firm* — Tucker Ellis LLP

(57) ABSTRACT

A movable passenger bridge to embark and disembark passenger to/from a ship is provided. The passenger bridge is movable and includes one or several telescopic sections, where the passenger bridge is arranged to connect to an opening in the hull of the ship. The section of the passenger bridge that is arranged closest to the ship has the largest cross section area. The passenger bridge is arranged so that the passengers can walk through the sections of the passenger bridge to a connection section, in the shape of a cabin, arranged to be connected to the mentioned opening in the hull of the ship or to an opening in the rail at deck of the ship. The passenger bridge is supported by a stand which is movable on the port quay, and that the passenger bridge is height-adjustable by means of the stand.

12 Claims, 2 Drawing Sheets

Figure 1:
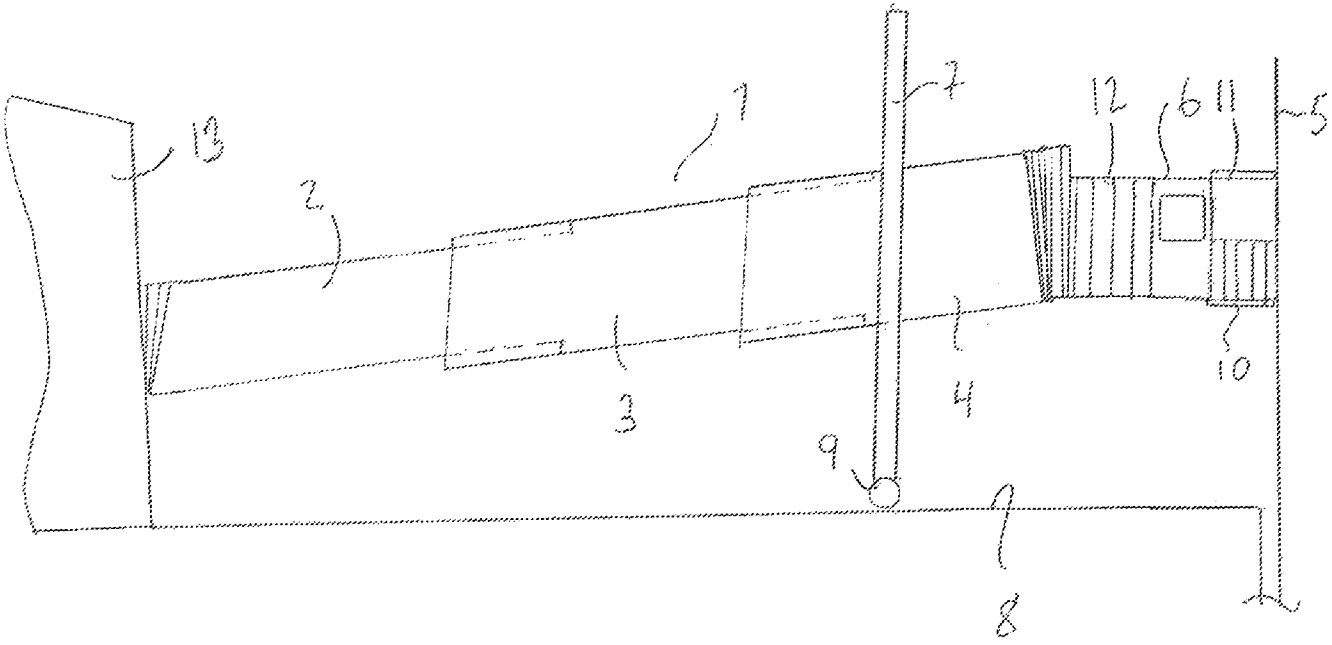

(58) Field of Classification Search
USPC ..... 14/71.5; 114/362
See application file for complete search history.

(56) References Cited

U.S. PATENT DOCUMENTS

| | | | | |
|---|---|---|---|---|
| 6,212,724 | B1 * | 4/2001 | Zhou | B64F 1/3055 14/69.5 |
| 6,330,726 | B1 | 12/2001 | Hione | |
| 6,487,742 | B1 | 12/2002 | Beazer | |
| 8,069,518 | B2 * | 12/2011 | Saito | B64F 1/305 14/71.5 |
| 8,266,750 | B2 * | 9/2012 | Peterson | B64F 1/305 14/71.5 |
| 8,505,140 | B2 | 8/2013 | Anderberg | |
| 2005/0279266 | A1 * | 12/2005 | Secretan | B63B 19/08 114/117 |
| 2009/0205147 | A1 * | 8/2009 | Gil Coto | B64F 1/305 14/71.5 |
| 2010/0257790 | A1 * | 10/2010 | Kim | B64F 1/3055 52/2.12 |
| 2010/0325818 | A1 * | 12/2010 | Okahira | B64F 1/3055 14/71.5 |
| 2014/0352085 | A1 * | 12/2014 | Larson | B64F 1/305 14/71.1 |
| 2016/0083114 | A1 * | 3/2016 | Kim | B64F 1/3055 14/71.5 |

FOREIGN PATENT DOCUMENTS

| | | | |
|---|---|---|---|
| JP | S64-043605 | A | 2/1989 |
| JP | H0419400 | U | 2/1992 |
| JP | 2005226344 | A | 8/2005 |
| SE | 1150086-5 | A1 | 9/2012 |

OTHER PUBLICATIONS

International Preliminary Report on Patentability from counterpart International Patent Application No. PCT/SE2014/050313, completed Dec. 30, 2015.

* cited by examiner

PASSENGER BRIDGES FOR CONNECTION TO A DOOR IN THE SIDE OF A SHIP

The present invention relates to a passenger bridge for connection to a door in the form of a passenger entrance in one side of a ship, or to an opening in the railing to the deck of a ship.

Such a passenger bridge is arranged to, with one end thereof, preferably be connected to a terminal building, and is arranged to, with its other end, be connected to a door opening in a ship's hull.

The sections are arranged to form an angle to the horizontal plane, in order to compensate for height differences between an entry/exit of a terminal building and said door in the hull.

Furthermore, the passenger bridge is supported by a frame, said frame supporting the sections. The frame is in turn supported by a number of wheels resting against a quayside where a ship is landed. The passenger bridge is movable in two mutually perpendicular directions, by way of one or more wheels being driven.

At least that section the free end of which is to be connected to a ship may be telescopic along its longitudinal direction.

One problem with such passenger bridges is that they preferably must be adaptable to all passenger ships that land at the port where the passenger bridge is arranged.

Different ships have differently sized openings, in different locations in the hull, for passenger embarking and disembarking.

To achieve a sufficiently small inclination to the horizontal plane of the passenger bridge, for it to be convenient for passengers to walk along the passenger bridge, the passenger bridge often consists of two or more sections that are telescopic relative to each other, so that a sufficient length of the passenger bridge is achieved. Then, an outer section runs externally to an inner section, causing the outermost section of the passenger bridge to have larger cross-sectional dimensions than the cross-sectional dimensions of the inner zone or zones. This is advantageous because passengers often gather and temporarily stop before boarding.

A so-called cabin, which is suspended so that it can rotate about a so-called bridge head 12 and comprising an arrangement of vertically arranged shutters, is present at the outer end of the outermost section. The cabin is arranged to pivot about the vertical axis of the bridge head, so that the position of the cabin opening can be adjusted so that it is parallel to the ship's side and door opening. Furthermore, the entire bridge head with the cabin is arranged to pivot about a horizontal axis, so that the floor of the bridge head and of the cabin remains horizontal.

Since the outermost section has the largest cross-sectional dimensions, and since the bridge head 12 and the cabin 6 have corresponding cross-sectional dimensions, a problem sometimes arises when the docking is done to a ship's door in the hull side, alternatively to an opening in a ship's deck railing, for the passengers to be able to embark and disembark.

The problem is that the bridge head 12 and the cabin 6 easily can interfere with adjacent parts of the ship, or with its equipment, such as lifeboats located near the ship's door.

This leads to both the risk of damage, and the docking becoming unnecessarily time-wasting.

The present invention solves these problems.

Hence, the present invention relates to a movable passenger bridge for embarking and disembarking of passengers to/from a ship, which passenger bridge is movable and comprises one or more telescopic sections, which passenger bridge is arranged to be connected to an opening in the hull of a ship or an opening in the railing to a boat deck, wherein that one of the passenger bridge sections that is arranged to be located closest to a ship has the largest cross-sectional area, which passenger bridge is arranged so that passengers can walk through the sections of the passenger bridge to a finishing section, in the form of a cabin, arranged to be connected to the opening in the ship's hull, and which passenger bridge is supported by a stand that is movable on a port's quay, and which passenger bridge is arranged to be raised and lowered by means of the stand, and is characterised in that the said cabin has a width corresponding to the width of the section to which the cabin is attached, in that the height of the cabin is lower than the height of the said section to which the cabin is attached, and in that the cabin at its end facing towards a ship is arranged with a protruding platform, which platform is arranged to connect to the side of a ship.

Figure 3:
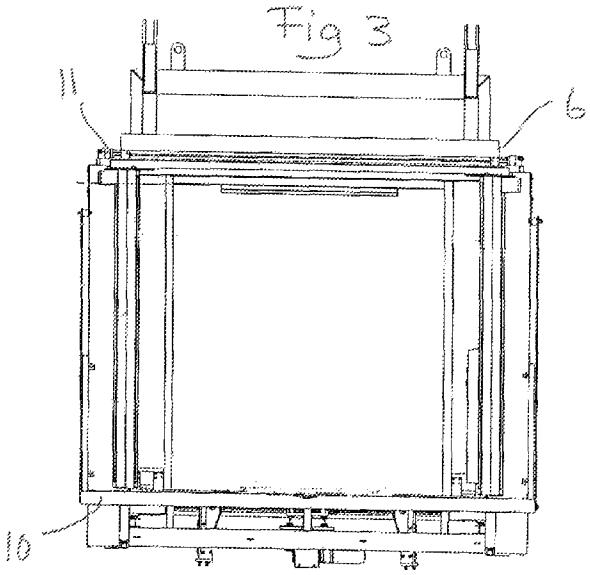
Figure 2:
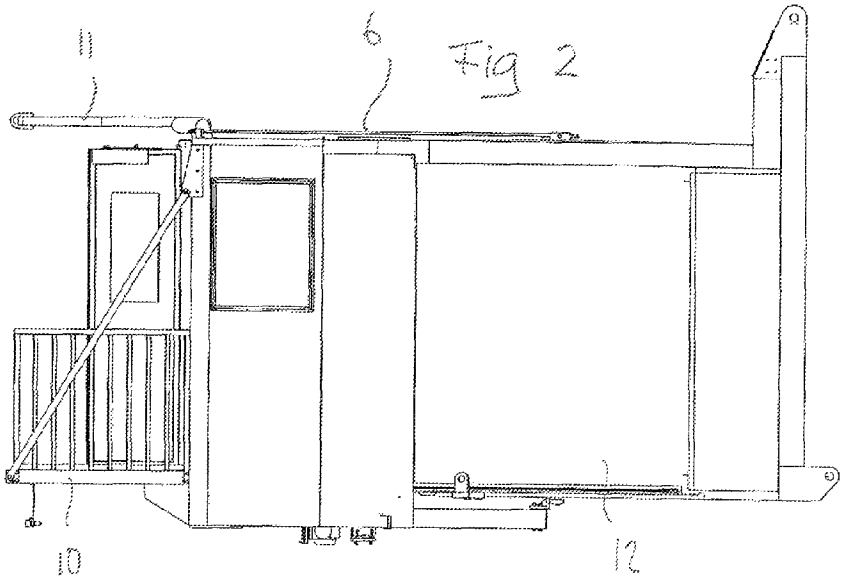
Figure 4:
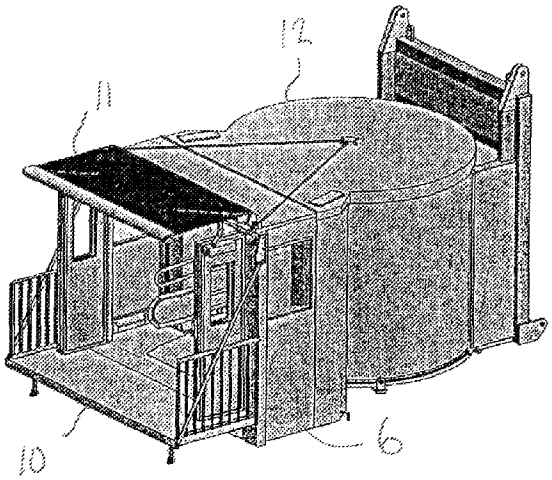

Below, the invention is described in closer detail, partly in connection with an embodiment shown in the accompanying drawings, wherein FIG. 1 shows schematically a telescopic passenger bridge according to the invention, comprising three sections FIG. 2 shows a cabin according to the invention, as seen from the side FIG. 3 shows the cabin in FIG. 3, as seen from the cabin opening FIG. 4 shows the cabin in a perspective view.

In FIG. 1 is shown a movable passenger bridge 1 for embarking and disembarking of passengers to/from a ship, which passenger bridge is movable and comprises one or more telescopic sections 2, 3, 4. The telescopic sections 2, 3, 4 are driven in a known manner so that they can be pushed into and out from each other.

The passenger bridge is pivotally connected to a terminal building 13. The free end of the passenger bridge is arranged to be connected to an opening in the hull 5 of a ship, or to an opening in the railing to a ship's deck, where that one of the passenger bridge sections 4 that is arranged to be located closest to a ship 5 has the largest cross-sectional area.

The passenger bridge 1 is arranged so that passengers can walk through the sections of the passenger bridge to a finishing section, in the form of a cabin 6, arranged to be connected to the opening in the ship's hull 5. The passenger bridge 1 is supported by a stand 7, which is movable on a port's quay 8. The passenger bridge 1 is arranged to be raised and lowered by means of the stand 8. The stand 8 is driven by a wheel 9 which abuts against the quay 8. The stand 7 is arranged to, using suitable known control circuits, be driven along the quay 8 and to raise or lower the passenger bridge so that the cabin 6 can be docked to the ship at the opening in the ship.

The cabin 6 comprises a so called bridge head 12, using which the cabin can be turned about a vertical axis, so that the free end of the cabin is parallel to the side of the ship. Furthermore, the cabin 6 is mounted at the outermost section 4, so that the cabin can be turned about a horizontal axis so that the floor of the cabin in turn is horizontal.

According to the invention, the said cabin 6 has a width corresponding to the width of the section 4 to which the cabin is attached. The height of the cabin 6 is lower than the height of the said section 4 to which the cabin is attached. Furthermore, the cabin 6, at its end facing towards a ship, is arranged with a protruding platform 10, which platform is arranged to connect to the side 5 of a ship.

The external height of the cabin is 0.75 m-1.25 m lower than the height of the said section 4 to which the cabin is fastened via the bridge head.

The bridge head has an external height corresponding to the external height of the cabin.

As a result of the cabin's lower height and the existence of the platform, interference between the cabin and adjacent parts of the ship or its equipment, such as lifeboats, located near the ship's door, can be avoided. The lower height of the cabin means that the room for maneuvering of the cabin increases in the vertical direction when the cabin is to be docked to the ship. Furthermore, the said platform results in that the entire cross-section of the cabin does not need to fit next to the side of the ship, but the cabin can be maneuvered so that the free end of the platform 10 is connected to the opening in the ship. This way, the maneuvering of the passenger bridge is facilitated when docking with a ship.

According to a preferred embodiment, the interior height of the cabin lies in the range of 2.10 m-2.50 m. A suitable internal height is 2.25 m. Preferably, the bridge head has an interior height which is equal to the interior height of the cabin.

According to another preferred embodiment, the said platform has a length, parallel to the passenger bridge, which lies within the range of 1 m-2 m.

It is preferred that the cabin is provided with an awning 11 above the cabin opening, which is arranged to be protruded over said platform to protect the passengers against precipitation.

The passenger bridge may have a design which is different from the exemplifying embodiment shown in the drawings. For example, the passenger bridge may have a design in terms of sections similar to the passenger bridge that is taught by Swedish patent no. 1150086-5. The passenger bridge, as well as the cabin design, may be varied depending on the needs to be met by the passenger bridge.

The present invention shall therefore not be considered limited to the above described embodiments, but can be varied within the scope of the accompanying claims.

The invention claimed is:

1. Movable passenger bridge for embarking and disembarking of passengers to/from a ship, which passenger bridge is movable and comprises one or more telescopic sections, which passenger bridge is arranged to be connected to an opening in the hull of a ship, wherein that of the passenger bridge sections that is arranged to be located closest to a ship has the largest cross-sectional area, which passenger bridge is arranged so that passengers can walk through the sections of the passenger bridge to a finishing section, in the form of a cabin, arranged to be connected to the opening in the ship's hull or to an opening in the railing to a ship's deck, and which passenger bridge is supported by a stand that is movable on a port's quay, and which passenger bridge is arranged to be raised and lowered by means of the stand, wherein the cabin comprises a bridge head, arranged so that the cabin can be turned about a vertical axis, and the cabin furthermore can be turned about a horizontal axis, and the cabin has a width corresponding to the width of the section to which the cabin is attached, the height of the cabin is 0.95 m-1.25 m lower than the height of the said section to which the cabin is attached, and the cabin at its end facing towards a ship is arranged with a protruding platform, which platform is arranged to connect to the side of a ship.

2. Passenger bridge according to claim 1, wherein an interior height of the cabin lies within the interval of 2.10 m-2.50 m.

3. Passenger bridge according to claim 1, wherein an interior height of the bridge head lies within the interval of 2.10 m-2.50 m.

4. Passenger bridge according to claim 1, wherein the platform has a length, in parallel to the passenger bridge, which lies within the interval of 1 m-2 m.

5. Passenger bridge according to claim 1, wherein the cabin is arranged with an awning above the opening of the cabin, arranged to protrude above the said platform.

6. Passenger bridge according to claim 2, wherein an interior height of the bridge head lies within the interval of 2.10 m-2.50 m.

7. Passenger bridge according to claim 2, wherein the platform has a length, in parallel to the passenger bridge, which lies within the interval of 1 m-2 m.

8. Passenger bridge according to claim 3, wherein the platform has a length, in parallel to the passenger bridge, which lies within the interval of 1 m-2 m.

9. Passenger bridge according to claim 2, wherein the cabin is arranged with an awning above the opening of the cabin, arranged to protrude above the said platform.

10. Passenger bridge according to claim 3, wherein the cabin is arranged with an awning above the opening of the cabin, arranged to protrude above the said platform.

11. Passenger bridge according to claim 4, wherein the cabin is arranged with an awning above the opening of the cabin, arranged to protrude above the said platform.

12. Movable passenger bridge for embarking and disembarking of passengers to/from a ship, the passenger bridge comprising:

at least first and second telescopic sections, the second section being configured to be located closer to the ship than the first section and having a larger cross-sectional area than the first section;

a stand supporting the at least first and second telescopic sections and being movable on a port's quay to raise and lower the passenger bridge; and a cabin mounted at the second section to be turned about a horizontal axis and configured to be connected to an opening in the ship's hull or to an opening in a railing to the ship's deck, the cabin including a bridge head configured so that the cabin can be turned about a vertical axis, wherein the cabin has a width corresponding to a width of the second section and a height that is 0.95 m-1.25 m lower than a height of the second section.

* * * * *